United States Patent [19]

McCarty

[11] 4,045,974

[45] Sept. 6, 1977

[54] COMBINATION MOTOR COOLER AND STORAGE COIL FOR HEAT PUMP

[75] Inventor: William J. McCarty, Louisville, Ky.

[73] Assignee: General Electric Company, Louisville, Ky.

[21] Appl. No.: 713,439

[22] Filed: Aug. 11, 1976

[51] Int. Cl.[2] ..... F25B 41/00

[52] U.S. Cl. ..... 62/196 B; 62/324; 62/505

[58] Field of Search ..... 62/174, 196 B, 324, 62/505

[56] References Cited

U.S. PATENT DOCUMENTS

| | | | |
|---|---|---|---|
| 2,959,937 | 11/1960 | Coyne | 62/324 |
| 2,967,410 | 1/1961 | Schulze | 62/505 |
| 3,006,162 | 10/1961 | Massa | 62/324 |
| 3,006,163 | 10/1961 | Kooiker | 62/324 |
| 3,006,164 | 10/1961 | McMillan | 62/324 |
| 3,105,633 | 10/1963 | Dellario | 62/505 |
| 3,109,297 | 11/1963 | Rinehart | 62/505 |
| 3,110,164 | 11/1963 | Smith | 62/324 |
| 3,276,221 | 10/1966 | Crumley | 62/505 |

*Primary Examiner*—Ronald C. Capossela

*Attorney, Agent, or Firm*—Frank P. Giacalone; Francis H. Boos

[57] ABSTRACT

The present invention relates to a reversible refrigeration system providing a combination of cooling the hermetic motor of the system during the cooling cycle of the system by injecting a portion of refrigerant from the system into the discharge flow of the compressor and storing portion of the refrigerant during the heating cycle.

2 Claims, 2 Drawing Figures

COMBINATION MOTOR COOLER AND STORAGE COIL FOR HEAT PUMP

BACKGROUND OF THE INVENTION

1. Field of the Invention:

The present invention relates to a heat pump refrigeration system employing a hermetic motor compressor wherein compressed refrigerant passes over the motor prior to being discharged into the system, and more particularly, to an automatic valved system for providing cooling of the refrigerant discharged from the compressor prior to its passage over the motor when the system is operating in the cooling cycle. The valved system further provides for the storage of excess refrigerant when the refrigeration system is operating in the heating cycle.

2. Description of the Prior Art:

The present invention is employed in conjunction with a hermetic motor compressor of the type disclosed in U.S. Pat. Nos. 3,105,633-Dellario and 3,109,297-Rinehart, both being assigned to the General Electric Company, assignee of the present invention. Both of the above patents disclose means for cooling the motor to maintain its temperature within safe operating limits. The method of motor cooling employed by the above patents is to pass the high pressure discharge gas from the compressor unit over the motor after this high pressure gas has been cooled to a low enough temperature to remove heat from the motor. More particularly, liquid refrigerant is injected into the semi-compressed gas in the compression chamber so that temperature of the discharge gas is lowered prior to its passage into the casing and over the motor.

It has been recognized in the art that optimum operation of heat pumps on the cooling cycle, i.e., when the indoor heat exchanger is being used as an evaporator, requires a greater effective charge of refrigerant than that required for operation on the heating cycle, when the indoor coil is functioning as the condenser. Accordingly, many attempts have been made to solve this problem. U.S. Pat. No. 3,110,164-Smith discloses one of the prior art systems employed for accumulating a portion of the refrigerant charge during the heating cycle and for restoring the accumulated portion of the charge to the system during the cooling cycle.

SUMMARY OF THE INVENTION

By this invention there is provided a reversible refrigeration system adapted for heating and cooling, including a hermetic casing for containing a high pressure refrigerant gas. A motor-driven compressor unit in the casing includes a cylinder having an annular compression chamber, a rotor eccentrically rotatable within the chamber. The rotor has a peripheral surface adapted to move progressively into sealing relation with successive portions of the annular chamber. A blade is slidably arranged in the compressor and biased against the peripheral surface of the rotor to divide said chamber into high and low pressure sides. A gas suction port is provided for introducing low pressure refrigerant gas into the annular chamber, and a gas discharge port is provided for conducting hot compressed refrigerant gas from the chamber into the casing. The refrigeration system includes an indoor heat exchanger and an outdoor heat exchanger connected in reversible flow relationship, and means connected between said heat exchangers for expanding refrigerant from condenser pressure to evaporator pressure. A valve is arranged for reversing the flow of refrigerant through said system to operate each of the heat exchangers interchangeably as a condenser or as an evaporator. Refrigerant is injected into the compressing chamber through a port that is adapted to be covered and uncovered by the rotor during the rotation thereof. Refrigerant from the system is ducted to the injection port by a conduit having its other end connected at some point between the reversing valve and the outdoor coil.

Located in the conduit is a one-way refrigerant pressure responsive valve that is operable when the outdoor coil is operating as a condenser due to higher refrigerant pressure being present on the condenser side of the one-way valve relative to the pressure in the injector passageway. The valve operation permits a regulated portion of refrigerant flow to enter the conduit and be injected into the compression chamber through the injection port to lower the temperature of the refrigerant being compressed so that said refrigerant discharged into the casing is at a temperature sufficient to cool the motor and to maintain its temperature within operating limits.

Located in the conduit between the one-way valve and the injection port is a storage coil which receives a regulated portion of the compressed refrigerant when the outdoor coil is operating as an evaporator due to a higher refrigerant pressure being present on the injection port side of the one-way valve relative to the pressure on the evaporator side. This differential in pressure is effective in forcing the compressed refrigerant into the storage coil during the heating cycle and for maintaining the valve in its closed position.

DESCRIPTION OF THE PREFERRED EMBODIMENT

Figures 1, 2:
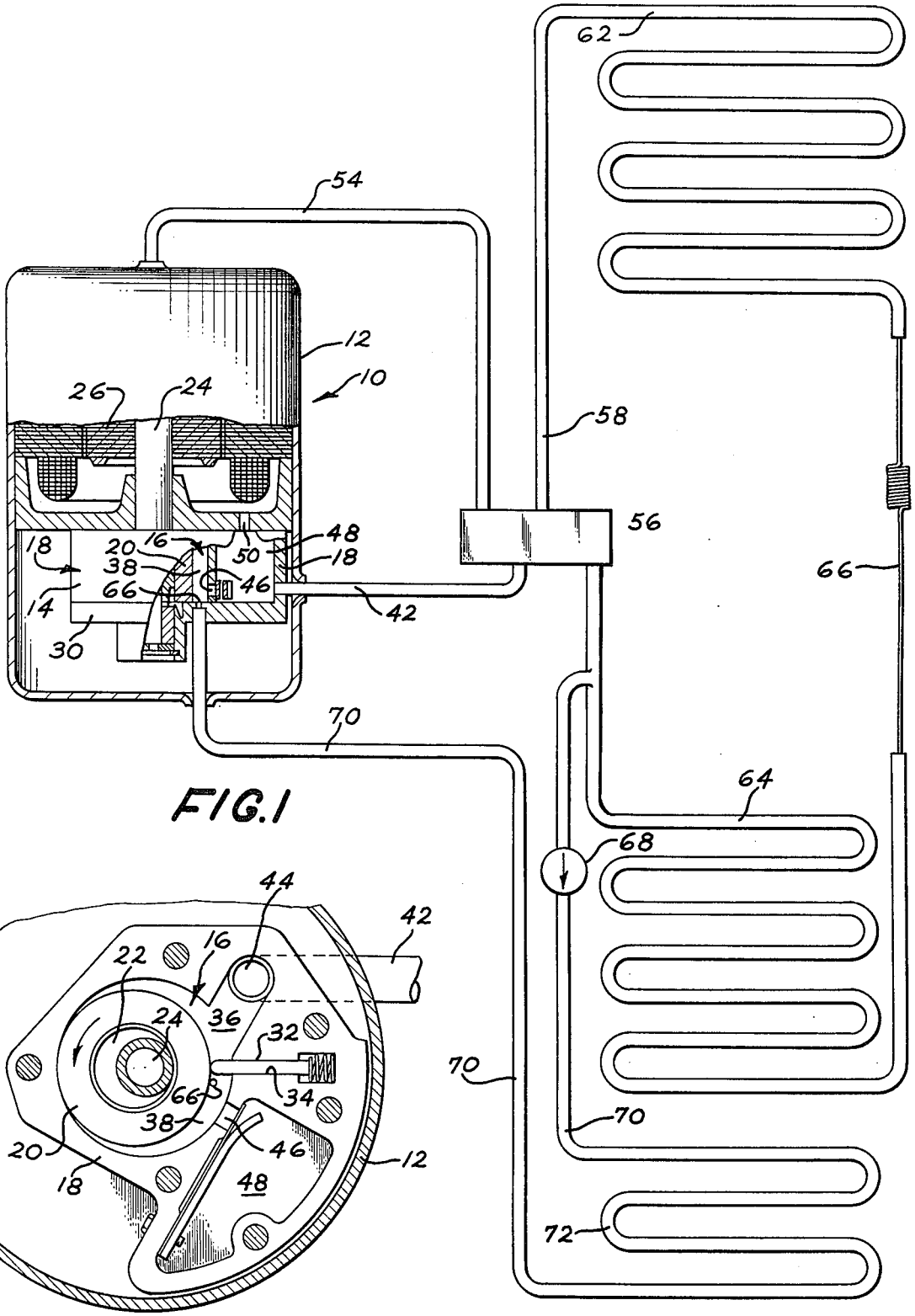
FIG. 1 is a schematic of a reversible cycle refrigeration system incorporating the present invention.
FIG. 2 is a partial plan view of the compressor unit taken along lines 2—2 of FIG. 1.

Referring now to the drawings, there is shown a hermetic compressor 10 including a casing 12 in which there is disposed a refrigerant compressor unit 14 having an annular chamber or compressor chamber 16 defined within a cylinder or housing 18. Disposed for rotation within the chamber 16 is a rotor 20 which is driven by an eccentric 22 formed as an integral part of the drive shaft 24 extending downwardly from the motor 26. A supporting frame 28 supports the shaft 24 above the eccentric 22 for rotation by the motor 26. It should be noted that the main frame 28 provides the upper end wall enclosing the annular compressor chamber 16. An opposite or lower end wall 30 encloses the bottom end of the chamber 16.

As may best be seen in FIG. 2, the cylinder 18 is provided with a radial slot 32 having slidably disposed therein a blade or vane 34 which is biased into engagement with the peripheral surface of the rotor 20 thereby dividing the chamber 16 into a low and high pressure side respectively designated 36 and 38. The hermetic compressor 10 is adapted to be connected into a refrigeration system and includes a suction line 42 which connects directly to the suction inlet 44 which communicates with the compressor chamber 16. The inlet 44 delivers low pressure gas into the low pressure side 36 of the compression chamber 16 where it is compressed between the peripheral surface of the rotor 20, the sides of the annular chamber 16, and the high pressure side of the vane 34, during rotation of the rotor 20 around the chamber. Means including a discharge 46 and discharge chamber 48 are provided for discharging the high pressure gas from the high pressure side 38 of the annular chamber 16 into the hermetic casing 12 through a passage 50 formed in the main frame 28. After flowing upwardly over the motor 26 the high pressure gas is conducted out of the hermetic casing 12 through a discharge line 54 in the upper end of the case.

The discharge line 54 and suction line 42 are both connected to a reversing valve 56. Also connected to the reversing valve 56 are a pair of conduits 58 and 60 which lead respectively to the indoor and outdoor heat exchangers or coils 62 and 64. Included in the system for the purpose of expanding refrigerants from condensing pressure to evaporator pressure is a capillary expansion means 66. This capillary 66 operates as an expansion means during both cooling and heating cycles and maintains a predetermined pressure differential between the evaporator and the condenser regardless of the direction of the refrigerant flow.

In an air conditioning unit of this type, the indoor coil 62 is arranged for heating or cooling air from the enclosure, while the outdoor coil 64 is arranged for either rejecting heat to or extracting heat from the outside atmosphere. The reversing valve 56 is selectively reversible to direct discharge gas into either one of the lines 58 and 60 while receiving low pressure gas from the other line, thereby making this system reversible for either heating or cooling an enclosure. Thus, if it is desirable to set this system on the heating cycle, compressor discharged gas flowing through discharge line is connected by means of the reversing valve 56 to the line 58 which carries the hot discharge gas to the indoor coil 62. This coil then acts as a condenser to give up its heat to the enclosure. If it is desired to set the system for cooling the enclosure, the suction line is connected to the indoor coil 62 through line 58 which then acts as an evaporator, while the discharge gas is carried to the outdoor coil 64 by the line 60.

In order to assure that the temperature of the discharge is sufficiently low to properly cool the motor as the gas is circulated thereover, the present invention provides means for injecting a relatively small quantity of the refrigerant into the compression chamber 16 during each compression cycle of the rotor 20. The refrigerant mixes with the semi-compressed gas in the high pressure side of the compressor and greatly reduces the discharge temperature of this gas. More specifically, there is provided an injection port or passageway 66 arranged in the high pressure side 38 of the compression chamber 16. The port 66 is so arranged with respect to the high pressure side 38 of the compression chamber 16, with respect to the rotor 20, that the peripheral edge of the rotor 20 completely covers the outlets of the port 66 at all times during each cycle of the rotor except for a short period during heat cycle when the gas pressure in the high pressure side 38 of the compression chamber 16 is between 50 percent and 95 percent of the discharge pressure which is generally 295 PSI.

Liquid refrigerant is supplied to the port 66 and more particularly, in the area 38 of the chamber 16 from a point in the system between the reversing valve 56 and the outdoor heat exchanger 64 through a conduit 68. During each compression cycle when liquid refrigerant is introduced into the port 66, it encounters the relatively hot semi-compressed gas in the chamber 38 and is vaporized or flashed into a gaseous form and mixes with the compressed gas. Heat removed from the semi-compressed gas in vaporizing the liquid refrigerant greatly reduces the temperature of the gas within the chamber 38 so that the resultant gas mixture issuing from the discharge port 46 and through the passage 50 is at a uniform temperature and much cooler than the temperature of the gas discharged from the compressor if liquid refrigerant were not added.

In the cooling mode, the refrigerant entering outdoor coil or, in this instance, condenser 64, is at approximately 295 PSI while the pressure in conduit 70 is less than 290 PSI. This difference in pressure causes a valve 68 arranged in conduit 70 to open so that during the cooling cycle refrigerant is bled from the system at approximately the pressure and temperature it enters the coil 64 which is operating as the condenser. Means are provided to cool the refrigerant passing through valve 68. To this end a coil 72 is arranged between valve 68 and port 66 so that refrigerant entering conduit 70 passes through coil 72 which in effect partially condenses and cools the refrigerant passing therethrough. This relatively cooler refrigerant is conducted through conduit 70 to port 66 in amounts sufficient to lower the temperature of the discharge gas so as to maintain the motor temperature within design limits as it passes therethrough.

When the system is in the heat pump mode and the coil 64 is operating as the evaporator, the flow or refrigerant from the evaporator 64 to the valve 56 is at approximately 30 PSI pressure, while the refrigerant in line 70 is at 240 PSI, which will maintain the valve 68 in its closed position and, accordingly, prevent flow in either direction therethrough, and motor cooling does not take place.

Generally, an overcharge of refrigerant results when the unit is switched over from the cooling to the heating cycle. This is attributable to the fact that a lower range of outdoor temperatures coming into contact with the outdoor coil 64 produces a lower pressure level in the outdoor coil, resulting in refrigerant being delivered to the motor compressor with a lower specific gravity. In this situation, the motor compressor pumps refrigerant through the circuit at a lower rate, weightwise, and, at the same time, the larger pressure difference between the indoor and outdoor coils tends to increase the rate of refrigerant flow through the capillary 66. As a result, the indoor coil 62 has a reduced level of liquid refrigerant and the outdoor coil 64 contains an excessive quantity of liquid refrigerant; and sometimes liquid refrigerant floods through to the suction line.

In accordance with the present invention, means are provided in conjunction with the motor cooling system that is operable during the cooling cycle to store refrigerant during the heating cycle. To this end, the coil 72 which is arranged in conduit 70 between valve 68 and port 66 serves as a storage coil when the system is operating in the heating cycle.

In the heat pump cycle, the pressure differentials in the system as explained above, are effective in maintaining the valve 68 closed. A portion of the semi-compressed gas will then enter line 70 and will continue to bleed until the storage coil 72 is filled with refrigerant. The refrigerant will remain in line 70 and storage coil 72 during the time the system is in the heat mode. It should be understood that the volume and size of the conduit 70 and storage coil 72 may be chosen by one skilled in the art to store the proper amount of refrigerant relative to the system requirements. To increase the efficiency of the storage coil 72 it is located in the ambient air flow through coil 64.

The conduit 70 and storage coil 72 is purged automatically when the system is switched to the cooling cycle. At that time, the valve 68 opens as explained hereinabove and liquid refrigerant stored in conduit 70 and storage coil 72 re-enters the refrigeration system through the port 66.

In summary, by the present invention, there is provided a system wherein motor cooling is provided during the cooling cycle when the compressor is operating in a relatively hot environment while automatically valving to provide refrigerant storage when the system is operating in the heating cycle. A return to the cooling cycle once again automatically valves to purge the stored liquid refrigerant back into the system.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A reversible refrigeration system adapted for heating and cooling, a hermetic casing for containing a high pressure refrigerant gas, a motor-driven compressor unit in said casing including a cylinder having an annular compression chamber, a rotor eccentrically rotatable within said chamber, said rotor having a peripheral surface adapted to move progressively into sealing relation with successive portions of said annular chamber, a blade slidably arranged in said compressor being biased against said peripheral surface of said rotor for following said rotor thereby to divide said chamber into high and low pressure sides, means including a gas suction port communicating with said annular chamber for introducing low pressure refrigerant gas into said annular chamber, means including a gas discharge port communicating with said annular chamber for conducting hot compressed refrigerant gas from said chamber into said hermetic casing, an indoor heat exchanger and an outdoor heat exchanger connected in reversible refrigerant flow relationship, means connected between said heat exchangers for expanding refrigerant from condenser pressure to evaporator pressure, means for reversing the flow of refrigerant through said system to operate each of said heat exchangers interchangeably as a condenser or as an evaporator, a refrigerant injection passageway in said compressor communicating with said compressing chamber being adapted to be covered and uncovered by said rotor during the rotation thereof, wherein the improvement comprises:

a conduit having one end connected at some point between said reversing valve and said outdoor coil and having its other end connected to said injection passageway;

a one-way refrigerant pressure responsive valve arranged in said conduit being operable when said outdoor coil is operating as a condenser due to higher refrigerant pressure being present on the condenser side of said one-way valve relative to the pressure in said injector passageway for permitting a regulated portion of refrigerant flow to enter said conduit and be injected into said compression chamber through said injection passageway to lower the temperature of said refrigerant being compressed so that said refrigerant discharged into said casing is at a temperature sufficient for cooling said motor and to maintain its temperature within operating limits.

2. The refrigeration system according to claim 1 wherein:

a storage coil is arranged in said conduit between said one-way valve and said injection passageway for receiving a regulated portion of said compressed refrigerant through said passageway when said outdoor coil is operating as an evaporator due to a higher refrigerant pressure being present on the passageway side of said one-way valve relative to the pressure on the evaporator side, said pressure differential being effective in forcing said compressed refrigerant into said storage coil during the heating mode and for maintaining said one-way valve in its closed position.

* * * * *